US012383052B2

(12) United States Patent
Knight

(10) Patent No.: US 12,383,052 B2
(45) Date of Patent: Aug. 12, 2025

(54) DRIVE COUPLER FOR POWER SCRUBBER

(71) Applicant: TECHTRONIC CORDLESS GP, Anderson, SC (US)

(72) Inventor: Tyler H. Knight, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 21 days.

(21) Appl. No.: 18/330,658

(22) Filed: Jun. 7, 2023

(65) Prior Publication Data

US 2023/0309686 A1 Oct. 5, 2023

Related U.S. Application Data

(63) Continuation of application No. 17/516,311, filed on Nov. 1, 2021, now Pat. No. 12,178,311.
(Continued)

(51) Int. Cl.

| | |
|---|---|
| ***A46B 13/02*** | (2006.01) |
| ***A46B 5/00*** | (2006.01) |
| ***A46B 13/00*** | (2006.01) |

(52) U.S. Cl.
CPC ..... *A46B 13/02* (2013.01); *A46B 5/005* (2013.01); *A46B 5/0083* (2013.01);
(Continued)

(58) Field of Classification Search
CPC ..... A46B 5/0095; A46B 13/008; A46B 13/02; A46B 5/005; A46B 5/0083; A46B 2200/30
See application file for complete search history.

(56) References Cited

U.S. PATENT DOCUMENTS

| | | | |
|---|---|---|---|
| 1,875,138 | A | 8/1932 | Pond et al. |
| 3,078,488 | A | 2/1963 | Helm |

(Continued)

FOREIGN PATENT DOCUMENTS

| | | | |
|---|---|---|---|
| CN | 201058006 | Y | 5/2008 |
| CN | 202458215 | U | 10/2012 |

(Continued)

OTHER PUBLICATIONS

Extended European Search Report for Application No. 21205957.0 dated Apr. 12, 2022 (8 pages).

(Continued)

*Primary Examiner* — Andrew A Horton
(74) *Attorney, Agent, or Firm* — Michael Best & Friedrich LLP

(57) ABSTRACT

A power scrubber including a telescopic shaft, a power receptacle, a handle, a power head, a pivot coupling, a first scrubber head, a second scrubber head, and a drive. The power receptacle and the handle are each positioned adjacent the first end. The pivot coupling couples the power head to the second end and is operable to adjust an angle of the power head relative to the shaft axis. The drive is coupled to and driven by the power head and extends along a longitudinal axis. The drive includes a first connector selectively engaging the first scrubber head with a center of the first scrubber head aligned with the longitudinal axis and a second connector selectively engaging the second scrubber head with a center of the second scrubber head aligned with the longitudinal axis. The first connector is connected to the first scrubber by a bayonet coupling.

15 Claims, 8 Drawing Sheets

Related U.S. Application Data

(60) Provisional application No. 63/109,235, filed on Nov. 3, 2020.

(52) U.S. Cl.
CPC ..... *A46B 5/0095* (2013.01); *A46B 13/008* (2013.01); *A46B 2200/30* (2013.01)

(56) References Cited

U.S. PATENT DOCUMENTS

| | | | | |
|---|---|---|---|---|
| 4,203,431 | A | 5/1980 | Abura et al. | |
| 4,391,548 | A | 7/1983 | Malish | |
| 4,534,733 | A | 8/1985 | Seigneurin et al. | |
| 4,757,565 | A | 7/1988 | Sanchez | |
| 4,763,373 | A | 8/1988 | Sanchez | |
| 4,773,120 | A | 9/1988 | Wang | |
| 4,780,922 | A | 11/1988 | Sanchez | |
| 4,780,992 | A | 11/1988 | McKervey | |
| 4,856,133 | A | 8/1989 | Sanchez | |
| 4,924,550 | A | 5/1990 | Wu | |
| 4,993,288 | A | 2/1991 | Anderson et al. | |
| 5,289,605 | A | 3/1994 | Armbruster | |
| 5,421,053 | A * | 6/1995 | Chodak | A47L 11/4069 15/49.1 |
| 5,423,102 | A | 6/1995 | Madison | |
| 5,645,365 | A * | 7/1997 | Malish | A47L 11/164 403/348 |
| 5,649,334 | A | 7/1997 | Henriquez et al. | |
| 5,697,115 | A | 12/1997 | Sciarra et al. | |
| 5,716,263 | A | 2/1998 | Jones et al. | |
| 5,794,300 | A | 8/1998 | Mccracken et al. | |
| 5,809,601 | A | 9/1998 | Rivera | |
| 5,956,792 | A | 9/1999 | Gutelius et al. | |
| 5,957,634 | A | 9/1999 | Carpinetti | |
| 6,253,405 | B1 | 7/2001 | Gutelius et al. | |
| 6,261,035 | B1 | 7/2001 | Moores, Jr. et al. | |
| 6,748,619 | B2 | 6/2004 | Quach | |
| 7,195,247 | B2 | 3/2007 | Shu | |
| 7,210,185 | B2 | 5/2007 | Paas | |
| 7,237,987 | B2 | 7/2007 | Hernandez, Jr. et al. | |
| 7,363,673 | B2 | 4/2008 | Schonewille et al. | |
| 7,414,337 | B2 | 8/2008 | Wilkinson et al. | |
| 7,707,674 | B2 | 5/2010 | Schonewille et al. | |
| 7,743,683 | B2 | 6/2010 | Dayton et al. | |
| 7,752,760 | B2 | 7/2010 | Baskar et al. | |
| 7,818,864 | B2 | 10/2010 | Wilkinson et al. | |
| 7,906,051 | B2 | 3/2011 | Mclain | |
| 7,937,792 | B2 | 5/2011 | Munn et al. | |
| 7,992,308 | B1 | 8/2011 | Fisher | |
| 8,069,520 | B2 | 12/2011 | Mattucci et al. | |
| 8,186,066 | B2 | 5/2012 | Doragrip et al. | |
| 9,032,576 | B2 | 5/2015 | Zelickson et al. | |
| 9,462,871 | B2 | 10/2016 | Machiorlette et al. | |
| 9,574,614 | B2 | 2/2017 | De Wit et al. | |
| 9,655,480 | B2 | 5/2017 | Fang et al. | |
| 9,737,179 | B2 | 8/2017 | Fang et al. | |
| 10,092,158 | B2 | 10/2018 | Larson et al. | |
| 10,159,331 | B2 | 12/2018 | Akashi et al. | |
| 10,624,448 | B2 | 4/2020 | Machiorlette et al. | |
| 2002/0049399 | A1 | 4/2002 | Stampf | |
| 2004/0081523 | A1 | 4/2004 | Vasudeva et al. | |
| 2006/0202571 | A1 | 9/2006 | Wilkinson et al. | |
| 2008/0092311 | A1 | 4/2008 | Munn et al. | |
| 2008/0244851 | A1 * | 10/2008 | Sutherland | A46B 13/008 15/176.1 |
| 2012/0260931 | A1 | 10/2012 | Martin et al. | |
| 2013/0098382 | A1 | 4/2013 | Martin et al. | |
| 2015/0245703 | A1 | 9/2015 | Zelickson et al. | |
| 2016/0324306 | A1 | 11/2016 | Martin et al. | |
| 2017/0000251 | A1 | 1/2017 | Machiorlette et al. | |
| 2019/0069750 | A1 | 3/2019 | Larson et al. | |
| 2020/0260860 | A1 | 8/2020 | Machiorlette et al. | |

FOREIGN PATENT DOCUMENTS

| | | | |
|---|---|---|---|
| CN | 204274335 | U | 4/2015 |
| CN | 104398222 | B | 1/2017 |
| CN | 107125913 | A | 9/2017 |
| CN | 206534285 | U | 10/2017 |
| CN | 206964338 | U | 2/2018 |
| CN | 210842870 | U | 6/2020 |
| CN | 210871344 | U | 6/2020 |
| CN | 210990017 | U | 7/2020 |
| DE | 2416922 | A1 | 10/1975 |
| DE | 2553194 | A1 | 6/1977 |
| DE | 19543794 | A1 | 7/1996 |
| DE | 102016217098 | A1 | 3/2018 |
| EP | 1066122 | B1 | 11/2003 |
| EP | 1529478 | A2 | 5/2005 |
| EP | 2628570 | A2 | 8/2013 |
| GB | 2389774 | A1 | 12/2003 |
| WO | 9206821 | A1 | 4/1992 |
| WO | 2008079944 | A2 | 7/2008 |

OTHER PUBLICATIONS

Boll, "Ryobi P4510 Power Scrubber Review," <https://opereviews.com/ryobi-p4510-power-scrubber-review/> article dated Aug. 21, 2020 (8 pages).

Shop Tool Reviews, "New Ryobi Power Scrubbers Review—EZ Cleaning [Works Underwater]," <https://www.youtube.com/watch?v=IGINIjv9Kqs> YouTube video publication date: Jun. 12, 2020.

* cited by examiner

DRIVE COUPLER FOR POWER SCRUBBER

CROSS-REFERENCE TO RELATED APPLICATION

This application is a continuation of U.S. Non-Provisional patent application Ser. No. 17/516,311, filed Nov. 1, 2021, which claims the benefit of U.S. Provisional Patent Application No. 63/109,235, filed Nov. 3, 2020, the entire contents of which are incorporated herein by reference.

TECHNICAL FIELD

The present disclosure relates to drive adapters, and more particularly to drive adapters for scrubbers and the like.

BACKGROUND

Hand tools and power tools are frequently connected to different sizes and/or types of tool heads. Tool heads may include bits, fasteners, and the like. In the context of powered scrubbers, tool heads may include brushes having various sizes, shapes, and stiffnesses. Connection mechanisms that are attachable to or integral with the tool permit connection between the head and the tool. The connection mechanism permits usage of the head upon actuation of the tool. Various tool heads may require different connections to the tool.

SUMMARY

In one independent aspect, a power tool includes a power head receiving power from a power source and a drive coupled to and driven by the power head. The drive extends along a longitudinal axis, and the drive includes a connector for selectively engaging one of a first working tool and a second working tool. The connector includes an internal bore configured to selectively engage a shank of the first working tool, and a lobe protruding radially outward from the longitudinal axis. The lobe has a locking mechanism configured to secure the second working tool in response to relative movement between the lobe and the second working tool in both an axial direction and a rotational direction.

In another independent aspect, a power scrubber includes a power head receiving power from a power source, and a drive coupled to and driven by the power head. The drive extends along a longitudinal axis, and the drive includes a connector for selectively engaging a working tool. The connector includes an external lobe protruding radially outwardly from the longitudinal axis, and a bayonet coupling angled in a rotational direction about the longitudinal axis and extending at least partially along the longitudinal axis. The bayonet coupling is configured to couple the drive with a brush having a corresponding bayonet coupling.

In yet another independent aspect, a power scrubber includes a shaft, a power source, a power head, and a drive. The shaft extends along a shaft axis between a first end and an second end, and the shaft includes a first portion adjacent the first end, and a second portion adjacent the second end. The second portion is movable relative to the first portion in a telescoping manner to adjust a length of the shaft along the shaft axis. The power source is coupled to the first end of the shaft. The power head includes a motor receiving power from the power source, and the power head is positioned adjacent the second end of the shaft. The drive is coupled to and driven by the power head, and the drive extends along a longitudinal axis. The drive includes a connector for selectively engaging one of a first working tool and a second working tool. The connector includes an internal bore configured to selectively engage a shank of the first working tool, and a lobe protruding radially outward from the longitudinal axis, the lobe having a bayonet coupling configured to engage the second working tool.

Other aspects of the disclosure will become apparent by consideration of the detailed description and accompanying drawings.

DETAILED DESCRIPTION

Figure 1:
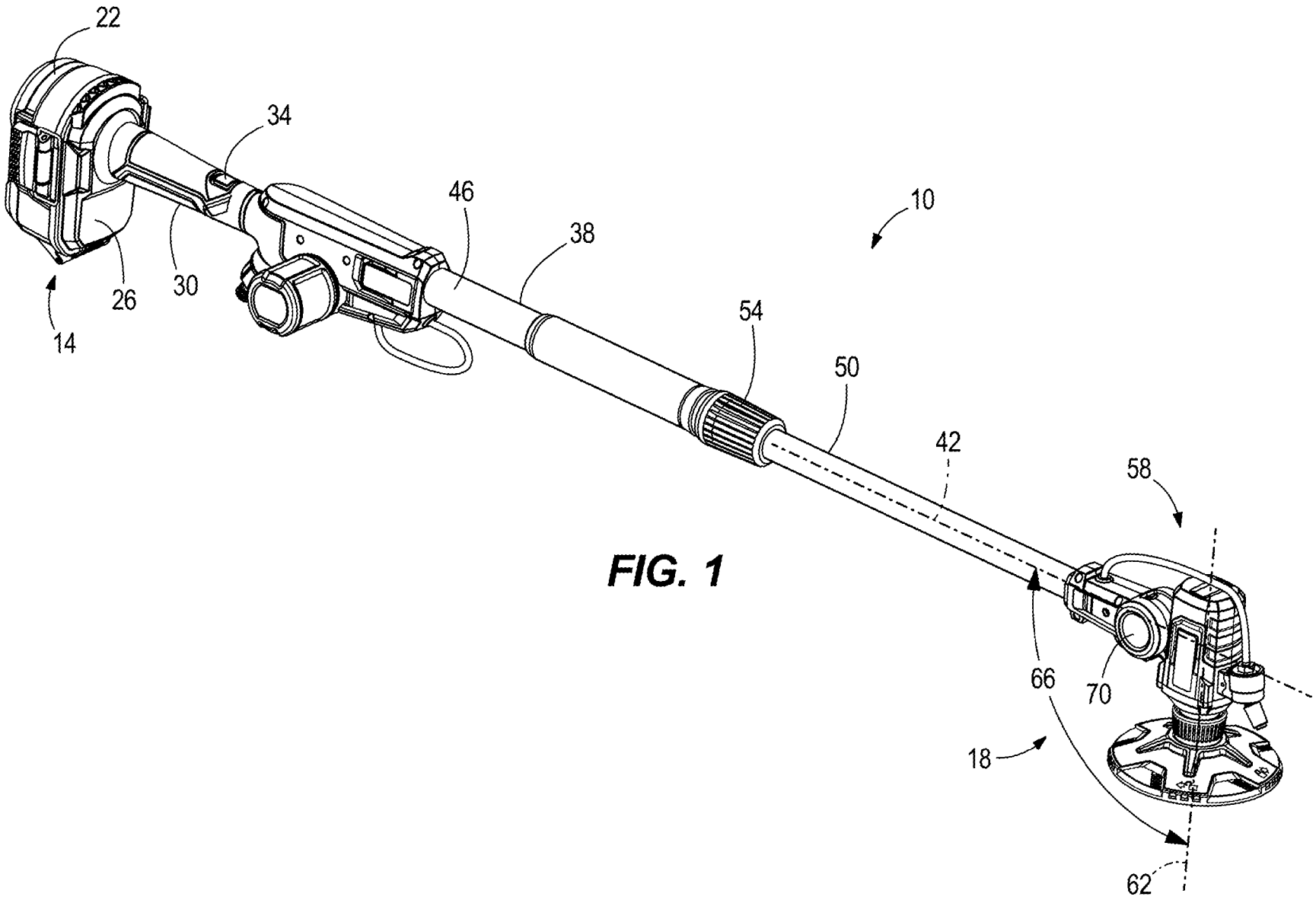
FIG. 1 is a perspective view of a power scrubber including a power head.

FIG. 1 illustrates a power scrubber 10. The illustrated power scrubber 10 may be a telescopic power scrubber extending between a first end 14 and an opposite a second end 18. The illustrated power scrubber 10 includes a removable power source 22 (e.g., a battery). The power source 22 is operable to engage a power receptacle 26 adjacent the first end 14. In other embodiments, the power source 22 may be integral with the power receptacle 26, and/or may receive power from a source other than a battery. A handle 30 and a trigger 34 are positioned adjacent the first end 14 of the power scrubber 10 to facilitate a user holding the handle 30 and operating the trigger 34 to actuate a power head 58 positioned adjacent the second end 18.

The power scrubber 10 includes a shaft 38 extending along a shaft axis 42 between the first end 14 and the second end 18. In the illustrated embodiment, the shaft 38 includes a first portion 46 and a second portion 50 coupled to the first portion 46 by a connector 54. The connector 54 facilitates telescoping movement of the second portion 50 relative to the first portion 46 to adjust a length of the shaft 38. In other embodiments, the shaft 38 may include more than two portions and more than one connector. In other embodiments, the power scrubber may include a fixed (i.e., non-telescoping) shaft 38. In such embodiments, the handle 30 is connected (e.g., directly connected) to a power head 58 to form a fixed, compact scrubber.

Figure 2:
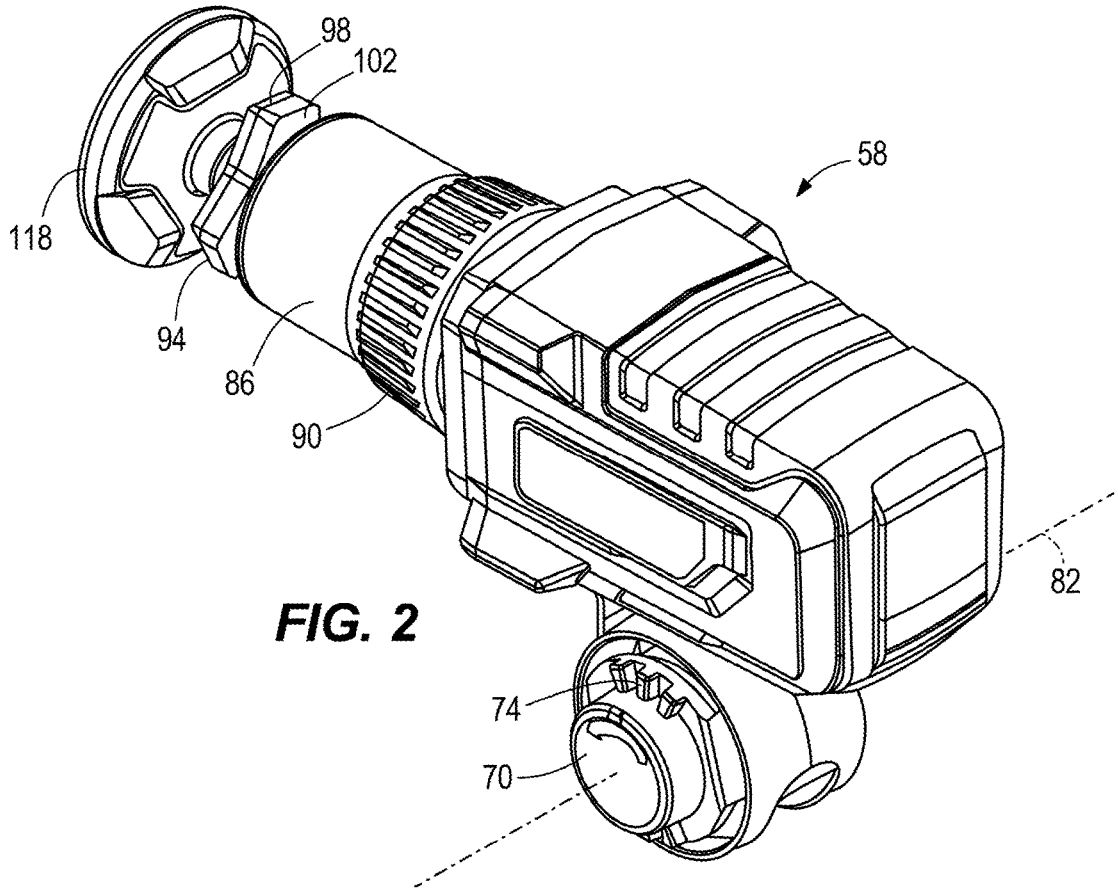
FIG. 2 is a perspective view of the power head of FIG. 1.
Figure 3:
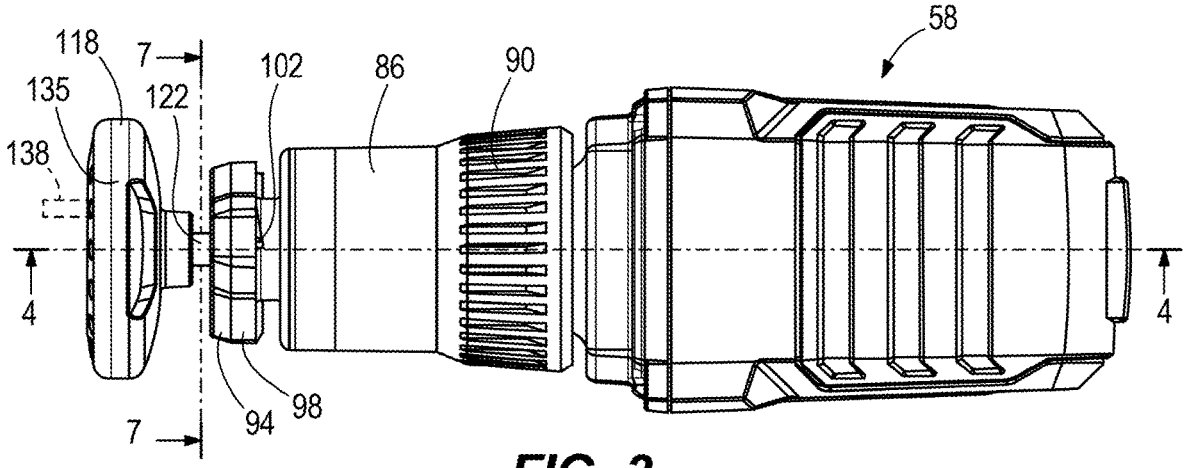
FIG. 3 is a top view of the power head of FIG. 1.

The power head 58 may be positioned adjacent the second end 18 and include a chuck or drive 86 (FIG. 2) extending along a longitudinal axis 62 (FIG. 1). The longitudinal axis 62 of the drive 86 may be oriented at an angle 66 (e.g., an acute angle, an obtuse angle, angle, etc.) relative to the shaft axis 42. A pivot coupling 70 couples the power head 58 to the shaft 38 and is operable to adjust the angle 66. As shown in FIG. 2, in the illustrated embodiment, the pivot coupling 70 may include pawls 74 that are configured to engage corresponding detents to fix the angle 66 in a desired position. In the exemplary embodiment, the pawls 74 are positioned on the portion attached to the power head 58, and the detents are positioned on the portion attached to the shaft 38. In adjusting the angle 66, the power head 58 rotates about a pivot axis 82 (FIG. 2). The angle 66 may be fixed by the pawls 74 in discrete positions corresponding to common angles. Such common angles may be, for example and without limitation, 0 degrees, 15 degrees, 30 degrees, 45 degrees, 60 degrees, 90 degrees, 105 degrees, etc. Although a pawl-and-detent design is illustrated in FIG. 2, it will be understood by persons having skill in the art that other types of couplings are contemplated, including a coupling that do not utilize discrete positions. That is, the power head 58 and longitudinal axis 62 of the drive 86 may be pivoted to any desired angle or location respective to the shaft axis 42.

As shown in FIGS. 2-7, the drive 86 of the power head 58 is operable to rotate in response to actuation of the trigger 34. The drive 86 includes a grip 90 which can be actuated (e.g., manually rotated) about the longitudinal axis 62 of the drive 86. The drive 86 engages a connector 94 extending along the longitudinal axis 62. In the illustrated embodiment, an inner portion of the drive 86 engages an outer surface of the connector 94. The connector 94 includes lobes 98 protruding radially outwardly from the longitudinal axis 62. In the illustrated embodiment, the connector 94 includes three lobes 98 in a generally triangular pattern (see FIG. 7) with each lobe 98 equidistant from the other lobes 98. In other embodiments, the connector may include fewer or more lobes, and/or the lobes may be positioned in a different configuration, such as, without limitation, a connector 94 having four lobes 98 in a cross or X-shaped pattern, or configurations in which the lobes 98 are not equidistant from the other lobes 98.

Figure 4:
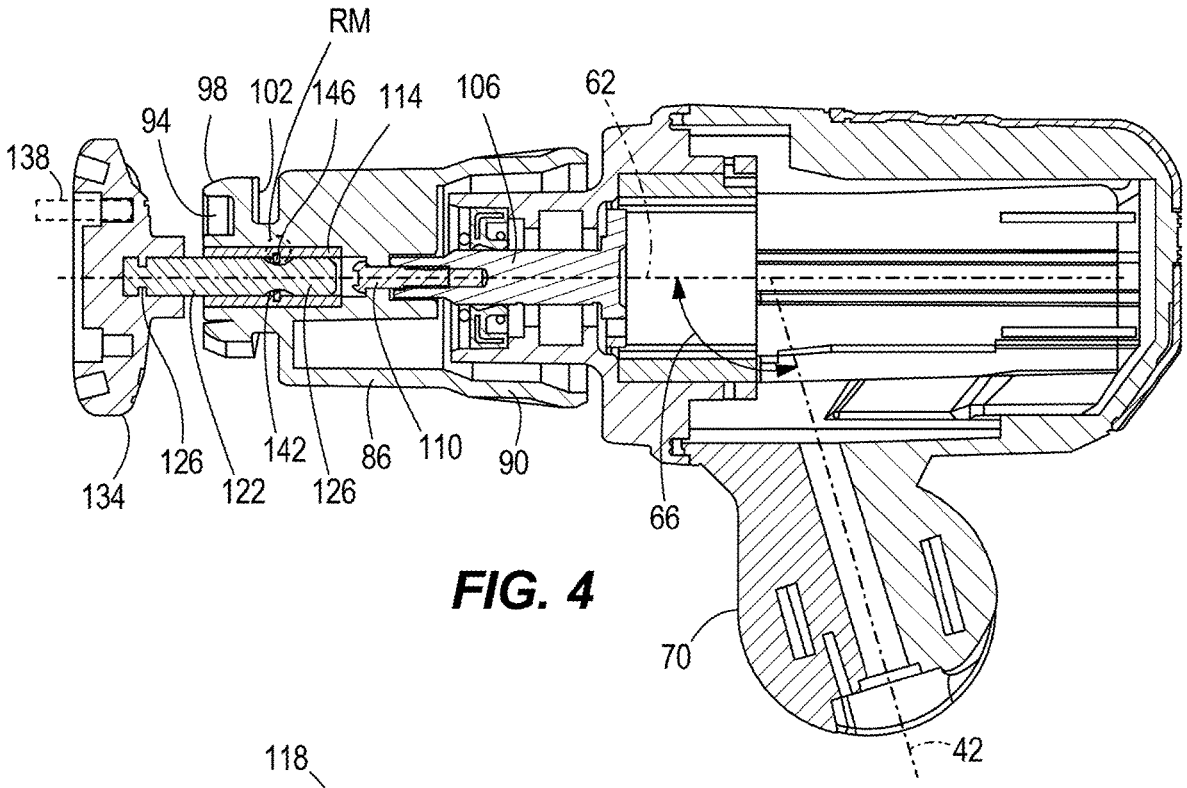
FIG. 4 is a cross-sectional view of the power head of FIG. 1 viewed along section 4-4 in FIG. 3.
Figure 5:
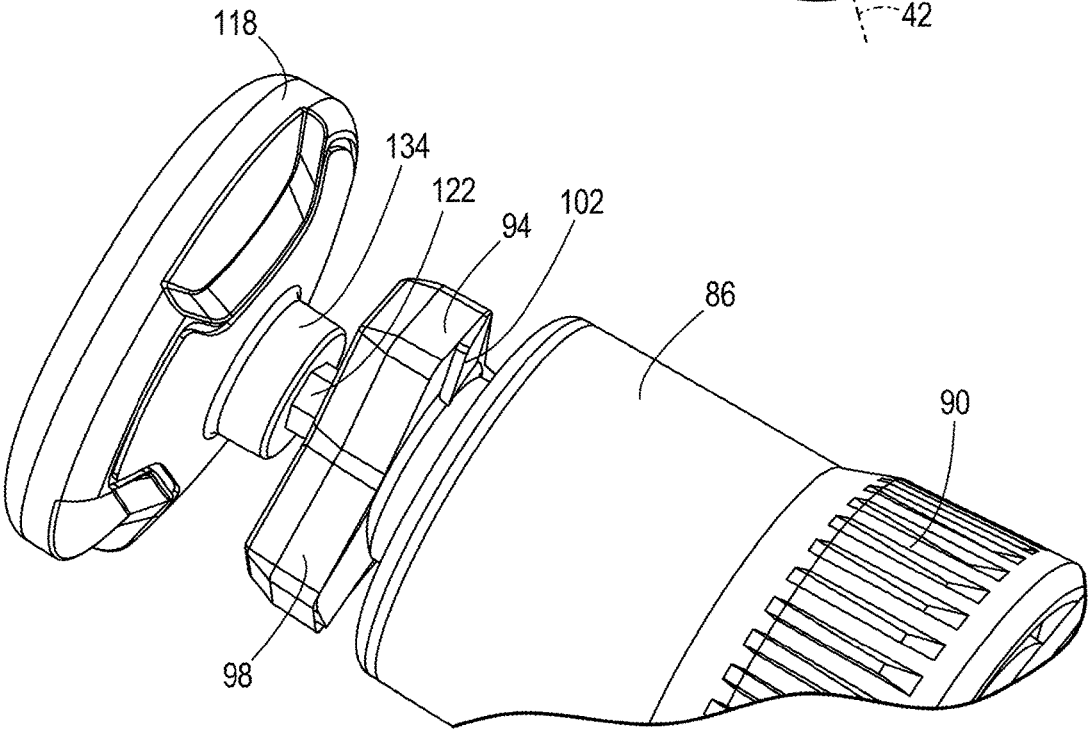
FIG. 5 is another perspective view of the power head of FIG. 1.
Figure 6:
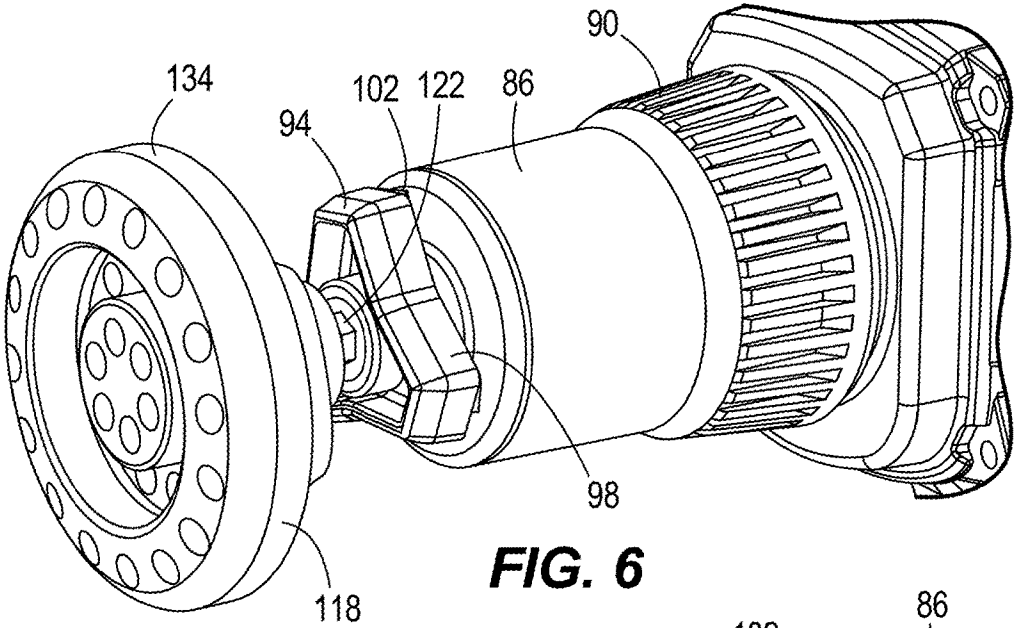
FIG. 6 is another perspective view of the power head of FIG. 1.
Figure 7:
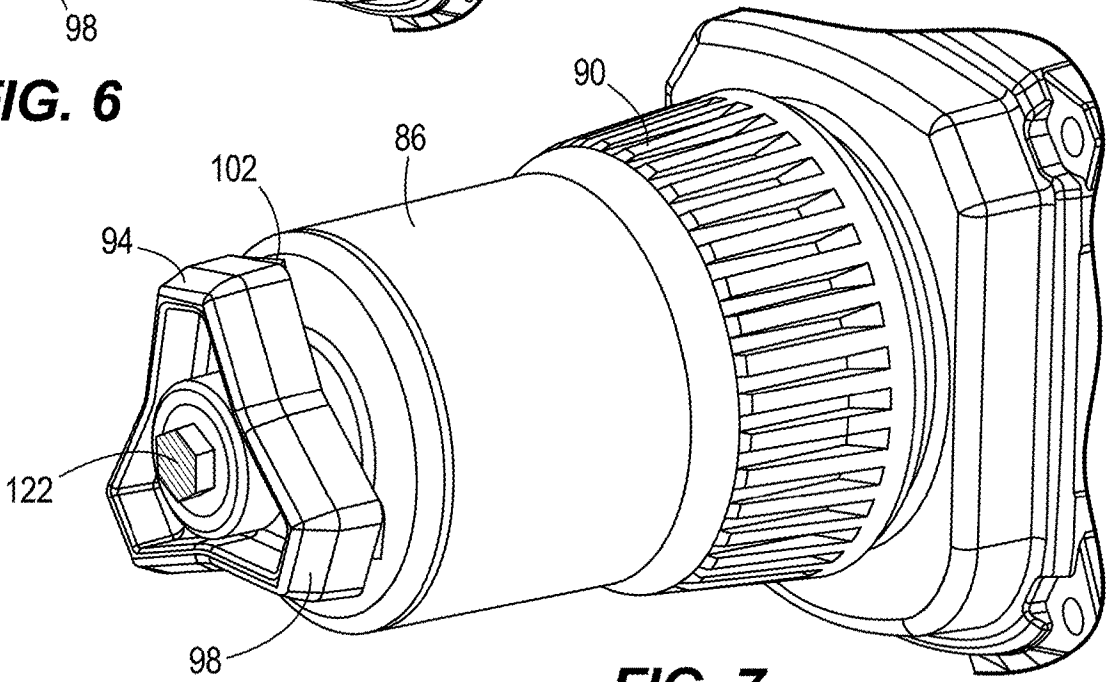
FIG. 7 is a section view of the power head of FIG. 1 viewed along section 7-7 in FIG. 3.

With reference to FIG. 4, each lobe 98 may include a sloping surface or ramp 102 located on an external face of the lobe 98 and extending at least partially along the longitudinal axis 62. In the illustrated embodiment, the ramp 102 extends along the longitudinal axis 62 in a rearward direction towards the drive 86. As best shown in FIG. 5, the ramp 102 may be angled in the rotational direction of the drive 86, and coupling the connector 94 to the drive 86 may require movement of at least one of the components in an axial direction and a rotational direction about the axis. For example, the connector 94 may include a bayonet coupling in which one component includes one or more pins that protrude radially and that engage and move along the ramp 102 to secure the connector. The ramp 102 may be angled relative to the longitudinal axis 62. In the illustrated embodiment, the angle of the ramp 102 extends rearwardly away from the lobe 98 and towards the drive 86. The ramp 102 is configured to couple the connector 94 with a working tool (not shown) having a corresponding bayonet coupling for engaging the ramp 102. The ramp 102 may releasably lock the position of the working tool relative to the connector 94. As such, power is at least partially transmitted from the drive 86 through the ramp 102 of the connector 94 to power the working tool. In the illustrated embodiment, the working tool may be, without limitation, a brush, pad, a scrubber, a polisher, and/or the like (not shown).

In the illustrated embodiment, the ramp 102 is a projection provided on the lobe 98 operable to engage a corresponding notch of the brush. In other embodiments, this configuration may be reversed, with the ramp 102 provided on the brush, and the corresponding notch being provided on the lobe 98. Accordingly, both the projection and the notch function as corresponding bayonet couplings.

With reference to FIG. 4, a drive mount 106 of the power head 58 is rotatably connected to the drive 86 by a drive fastener 110. As such, the drive fastener 110 can couple the drive 86 to the power head 58. In some embodiments, the drive fastener 110 may be a reverse threaded fastener.

With continued reference to FIG. 4, the connector 94 may include a drive bore 114 positioned within the connector 94 and receiving a shank 122 of a working tool to couple the working tool to the drive 86. In the illustrated embodiment, the drive bore 114 is hexagonal for engaging a hexagonal shank 122. In other embodiments, the drive bore 114 may have a different cross-sectional shape.

In the illustrated embodiment, the working tool is a scrubber head 118 having a shank 122. The shank 122 has a first end 126 and a second end 130. As shown in FIG. 4, a body 134 of the scrubber head 118 is attached at the first end 126 of the shank 122. The body 134 further includes bristles 138 for scrubbing a surface. The shank 122 includes a recess 142 for facilitating engagement with the drive 86. The drive 86 further includes a retaining ring 146 within the drive bore 114. The retaining ring 146 is configured to circumscribe the shank 122 at the recess 142 to retain the axial position of the shank 122 along the longitudinal axis 62. The recess 142 and retaining ring 146 can releasably lock the axial position of the shank 122 along the longitudinal axis 62. In other embodiments, the shank 122 may be retained in another manner.

Other embodiments may include, without limitation, an additional retention mechanism RM (FIG. 4). The retention mechanism RM may include a ball detent mechanism or a magnet. The ball detent mechanism may include a biased ball retainer configured to engage the recess 142. The magnet may be otherwise positioned on or within the shank 122 to provide magnetic force with a corresponding magnet of the connector 94 to retain the axial position of the shank 122. The corresponding magnet of the connector 94 may be positioned radially adjacent the first end 126 of the shank 122.

The cross-sectional shapes of the shank 122 and the drive bore 114 can releasably inhibit the rotation of the shank 122 about the longitudinal axis 62. The drive bore 114 is configured to couple the connector 94, and thus the drive 86, with a working tool (e.g., the scrubber head 118) having a shank (e.g., the shank 122). As such, power is transmitted from the drive 86 through the drive bore 114 of the connector 94 and the shank 122 to power the scrubber head 118.

Notably, the internal drive bore 114 and/or the external lobe 98 may both be used to transmit power from the drive 86 through the connector 94 to different types of scrubber heads (e.g., 118, 200 (FIG. 9), and/or the like). In the illustrated embodiment, the scrubber head 118 includes a shank 122 configured to receive power from the internal drive bore 114. In other embodiments (see e.g., FIG. 9), the scrubber head 118 may have bayonet couplings configured to engage the lobes 98. In this way, scrubber heads having either shanks 122 or bayonet couplings may be removably coupled with the same connector 94. In this way, the power head 58 may be coupled to and employ different types of scrubber heads, thus, improving the usability and adaptability of the powered scrubber 10. In other embodiments, scrubber heads 118 may be configured to receive power from both the internal drive bore 114 and the external lobe 98 simultaneously. Such scrubber heads 118 may include both a shank 122 configured to receive power from the internal drive bore 114 and a connector as discussed above (e.g., a bayonet coupling configured to engage the ramp 102 of the lobe 98). As previously noted, other types of locking mechanisms may be used, and the other types of locking mechanisms may include relative movement both axially and radially to secure the scrubber head 118 to the drive 86.

Figure 8:
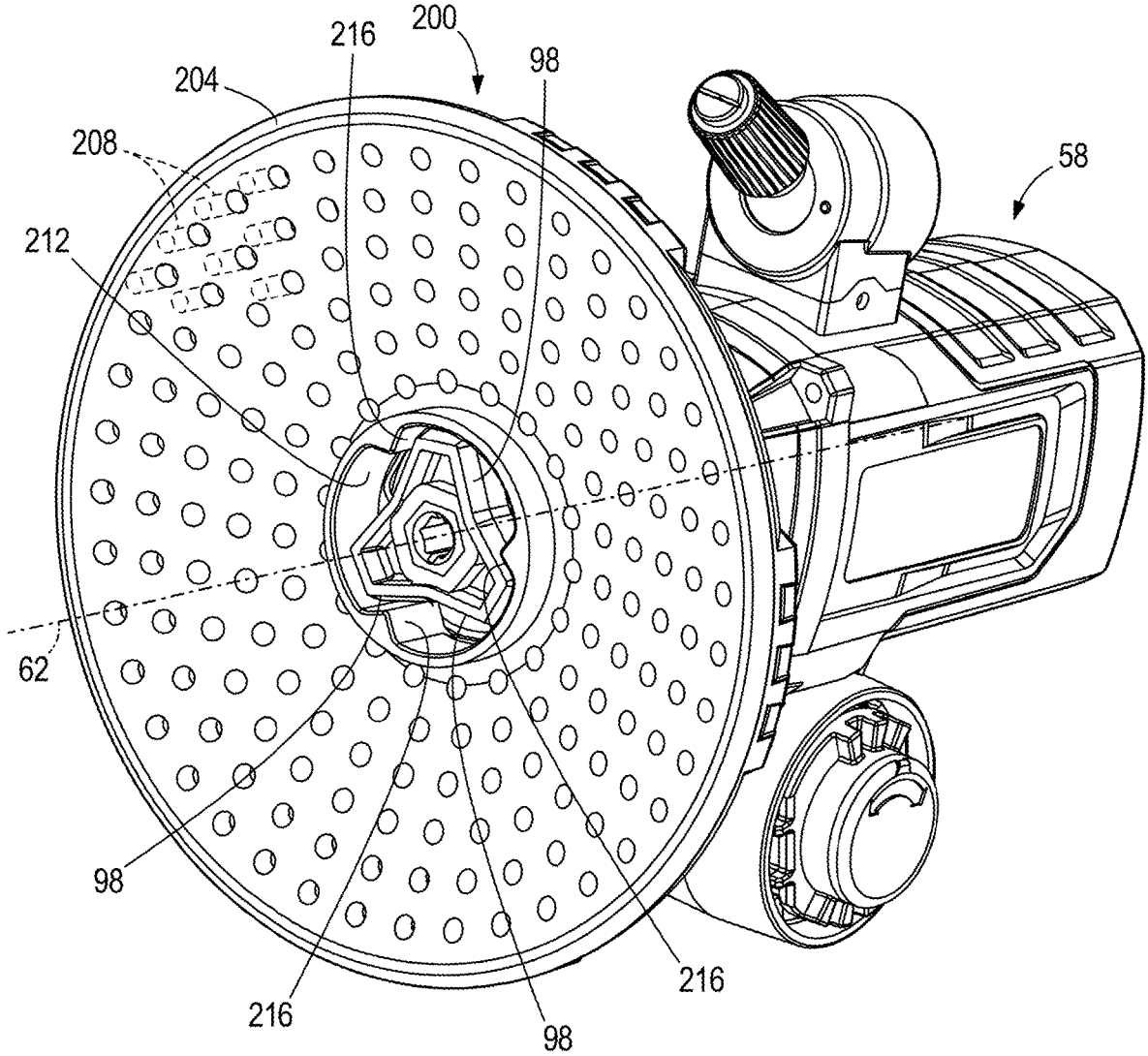
FIG. 8 is a perspective view of the power head with a scrubber head attached to the power head.

FIGS. 8-11 illustrate the power head 58 attached to a scrubber head 200. With reference to FIG. 8, the scrubber head 200 is generally dimensioned to engage the external lobes 98 and the ramps 102 of the power head 58. The scrubber head 200 includes a body 204 including bristles 208 for scrubbing a surface. The scrubber head 200 further includes an annular ring 212 at the center of the body 204 and aligned with the longitudinal axis 62. Triangular shoulders 216 extend radially inwardly from the annular ring 212 towards the longitudinal axis 62. The shoulders 216 are dimensioned to correspond with the lobes 98. Accordingly, as the drive 86 is rotated, the lobes 98 press upon the shoulder 216 to transmit torque from the drive 86 to the scrubber head 200, the bristles 208, and ultimately a work surface.

Figure 9:
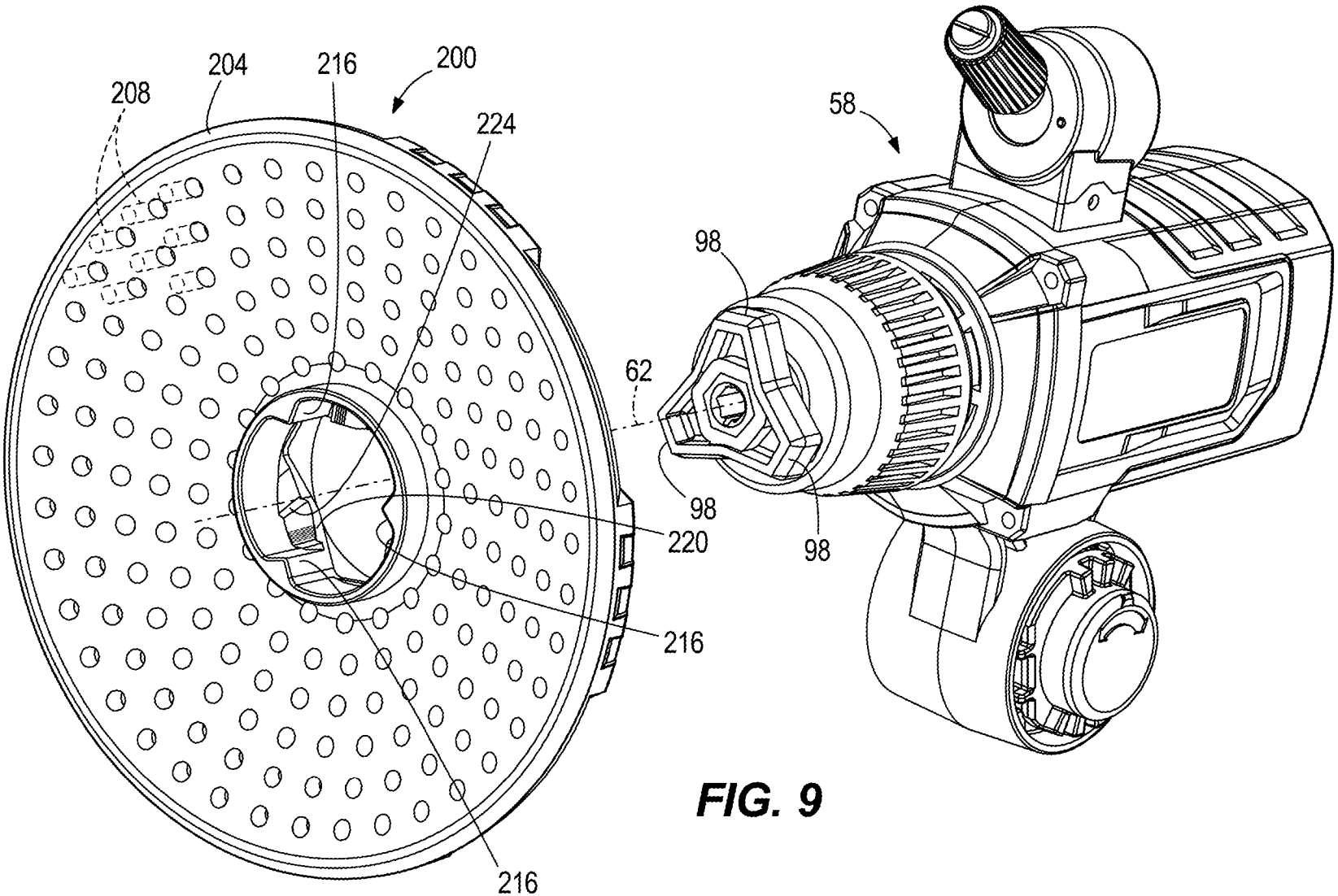
FIG. 9 is a perspective view of the power head with the scrubber head removed from the power head.
Figure 10:
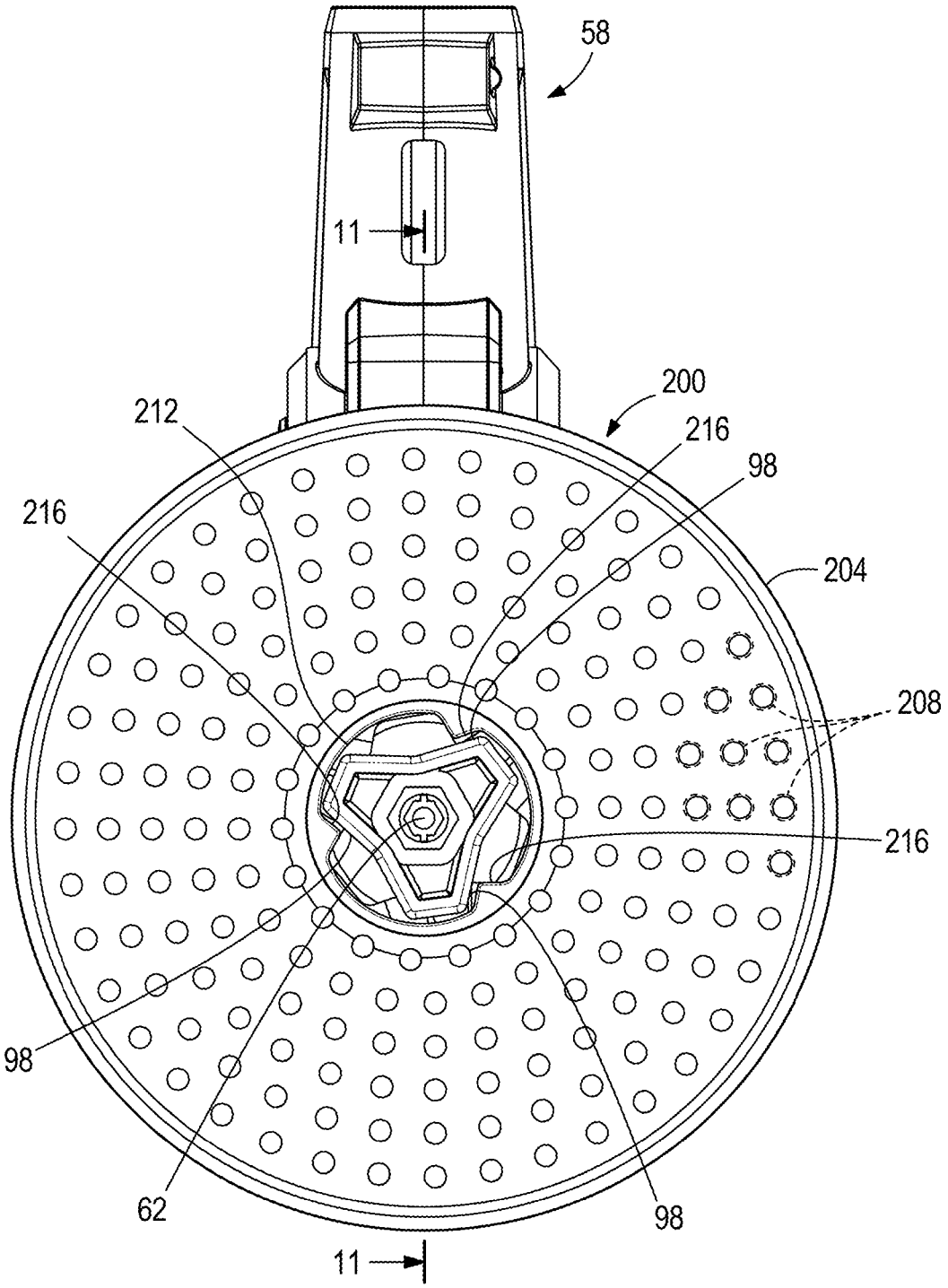
FIG. 10 is an end view of the power head and scrubber head of FIG. 8.
Figure 11:
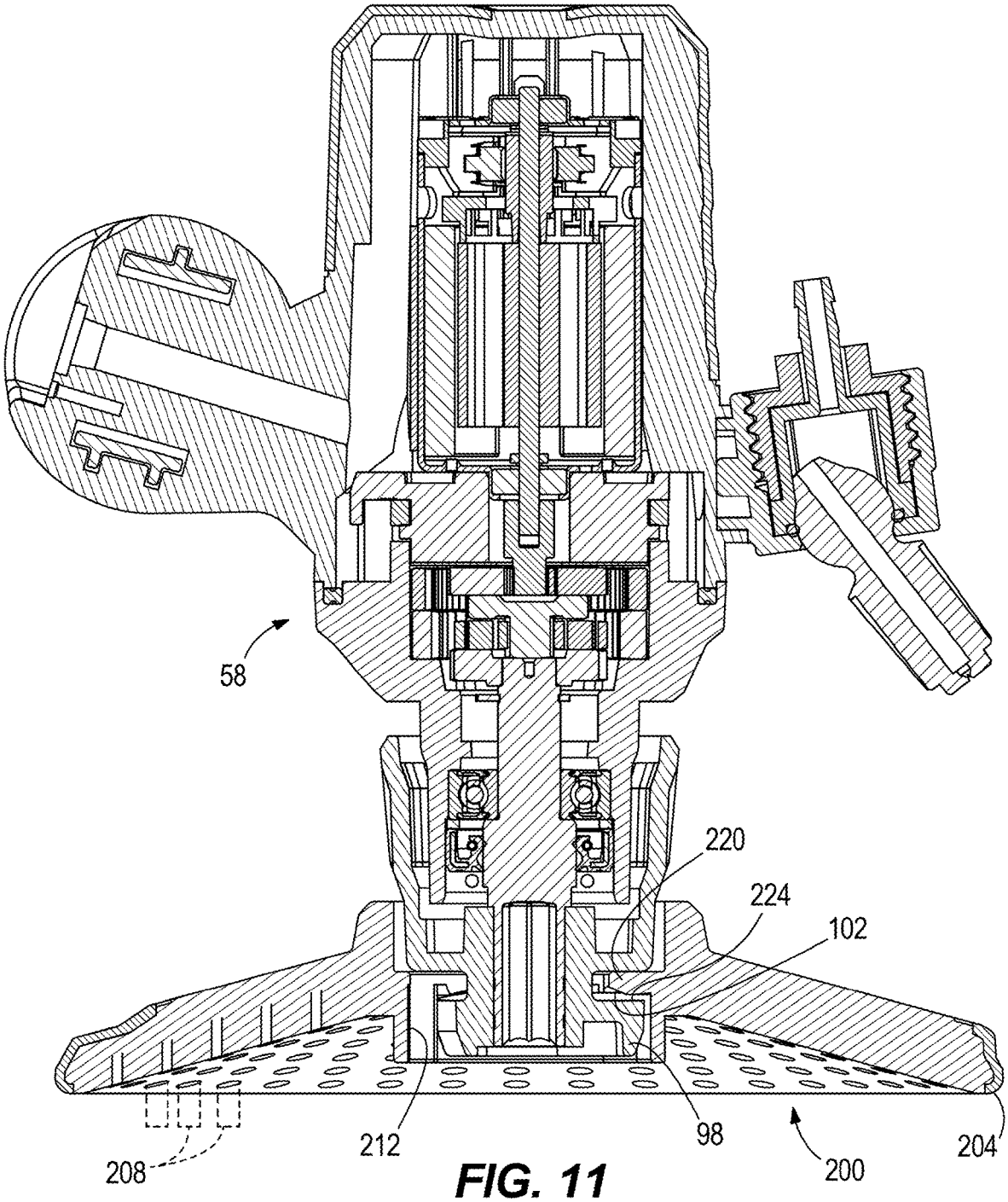
FIG. 11 is a cross-sectional view taken along section line 11-11 in FIG. 10.

FIG. 9 illustrates the scrubber head 200 removed from the power head 58. The scrubber head 200 includes a plate 220 which extends radially inwardly from the annular ring 212 and generally perpendicular from the longitudinal axis 62. The plate 220 is located circumferentially between the shoulders 216. There is a radial gap between the plates 220 and the shoulders 216. Accordingly, the plate 220 is dimensioned to receive the lobes 98 such that the scrubber head 200 can be translated (e.g., pushed, pulled, slid, etc.) along the longitudinal axis 62 to an axial position where the scrubber head 200 is axially aligned with the lobes 98.

The plate 220 may include one or more detents 224 which correspond to the dimensions of the ramps 102. The detents 224 function as bayonet couplings, and engage the ramps 102. Each detent 224 may be configured to receive one ramp 102 of one lobe 98. Each detent 224 may include a plurality of surfaces which are angled relative to a plane perpendicular to the longitudinal axis 62. Accordingly, the angled ramps 102 may be wedged in the detents 224 to secure the lobes 98 to the scrubber head 200. While in the above-described axial position, the scrubber head 200 can be rotated to a radial position in which at least one of the plurality of surfaces of the detents 224 receive the ramps 102. Accordingly, the detents 224 can lock the scrubber head 200 to the drive 86 for co-rotation therewith.

Although aspects of the disclosure have been described in detail with reference to certain embodiments, variations and modifications exist within the scope and spirit of one or more independent aspects as described. Various features and advantages are set forth in the following claims.

What is claimed is:

1. A power scrubber comprising:

a shaft extending along a shaft axis between a first end and a second end, the shaft including a first portion and a second portion, the second portion movable relative to the first portion in a telescoping manner to adjust a length of the shaft along the shaft axis;

a power receptacle configured to receive power from a power source, the power receptacle being positioned adjacent the first end of the shaft;

a handle positioned adjacent the first end of the shaft;

a power head including a motor receiving power from the power source, the power head positioned adjacent the second end of the shaft;

a pivot coupling that couples the power head to the second end of the shaft, the pivot coupling operable to adjust an angle of the power head relative to the shaft axis;

a first scrubber head including a body having bristles;

a second scrubber head including a body having bristles; and a drive coupled to and driven by the power head, the drive extending along a longitudinal axis, the drive including a first connector configured to selectively engage the first scrubber head such that a center of the first scrubber head is aligned with the longitudinal axis, the first connector connected to the first scrubber by a bayonet coupling, and a second connector configured to selectively engage the second scrubber head such that a center of the second scrubber head is aligned with the longitudinal axis.

2. The power scrubber of claim 1, wherein, as viewed along the longitudinal axis, one of the first connector and the second connector is positioned within a periphery of the other of the first connector and the second connector.

3. The power scrubber of claim 1, wherein the first scrubber head includes a plurality of shoulders extending radially inwardly towards the longitudinal axis, wherein the first connector includes a plurality of lobes protruding radially outwardly from the longitudinal axis, and wherein each of the plurality of lobes engages one of the plurality of shoulders to drive the first scrubber head.

4. The power scrubber of claim 3, wherein the second scrubber head includes a shank, wherein the second connector includes a drive bore, and wherein the drive bore receives the shank.

5. The power scrubber of claim 1, wherein the power head includes a drive mount connected to the drive and the motor, and wherein the drive mount is aligned with the longitudinal axis.

6. The power scrubber of claim 1, wherein the first connector is configured to drive the first scrubber head in a rotational direction about the longitudinal axis, and wherein the second connector is configured to drive the second scrubber head in the same rotational direction about the longitudinal axis.

7. The power scrubber of claim 1, wherein the first scrubber head and the second scrubber head are configured to receive power from the both the first connector and the second connector simultaneously.

8. The power scrubber of claim 1, wherein the pivot coupling is operable adjust the power head to a plurality of angles relative to the shaft axis, wherein one of the plurality of angles orients the longitudinal axis parallel with the shaft axis, and wherein another one of the plurality of angles orients the longitudinal axis perpendicular with the shaft axis.

9. The power scrubber of claim 1, wherein the bayonet coupling comprises one or more pins that protrude radially and that move along a ramp to secure the first connector to the first scrubber.

10. The power scrubber of claim 1, wherein the bayonet coupling comprises a detent on the first scrubber that engages with a ramp on the drive to secure the drive to the first scrubber.

11. A power scrubber comprising:

a power head receiving power from a power source; and a drive coupled to and driven by the power head, the drive extending along a longitudinal axis, the drive including a first connector of a first type configured to selectively engage a first scrubber head such that a center of the first scrubber head is aligned with the longitudinal axis, and a second connector of a second type different than the first type, the second connector configured to selectively engage a second scrubber head such that a center of the second scrubber head is aligned with the longitudinal axis.

12. The power scrubber of claim 11, wherein the first connector and the second connector are rotatable about and coaxial along the longitudinal axis.

13. The power scrubber of claim 11, wherein at least a portion of the second connector is offset from the first connector in a direction parallel to the longitudinal axis.

14. The power scrubber of claim 11, wherein the first connector functions as a bayonet coupling.

15. The power scrubber of claim 14, wherein the second connector includes a ball detent mechanism configured to retain a shank of the second scrubber head.

* * * * *